US010264360B2

(12) United States Patent
Shao et al.

(10) Patent No.: US 10,264,360 B2
(45) Date of Patent: Apr. 16, 2019

(54) STRUCTURE FOR DETECTING VIBRATION DISPLACEMENT OF A SPEAKER AND ACOUSTOELECTRIC INTER-CONVERSION DUAL-EFFECT DEVICE

(71) Applicant: Goertek.Inc, Weifang, Shandong (CN)

(72) Inventors: Minghui Shao, Weifang (CN); Jianbin Yang, Weifang (CN)

(73) Assignee: Goertek.Inc, Weifang, Shandong (CN)

( * ) Notice: Subject to any disclaimer, the term of this patent is extended or adjusted under 35 U.S.C. 154(b) by 9 days.

(21) Appl. No.: 15/551,262

(22) PCT Filed: Nov. 26, 2015

(86) PCT No.: PCT/CN2015/095680
§ 371 (c)(1),
(2) Date: Aug. 15, 2017

(87) PCT Pub. No.: WO2016/155340
PCT Pub. Date: Oct. 6, 2016

(65) Prior Publication Data

US 2018/0035212 A1 Feb. 1, 2018

(30) Foreign Application Priority Data

Sep. 29, 2015 (CN) ..... 2015 2 0763528 U

(51) Int. Cl.
*H04R 9/06* (2006.01)
*H04R 3/00* (2006.01)
(Continued)

(52) U.S. Cl.
CPC ..... *H04R 9/06* (2013.01); *H04R 3/00* (2013.01); *H04R 7/06* (2013.01); *H04R 7/18* (2013.01);
(Continued)

(58) Field of Classification Search
CPC ..... H04R 9/06; H04R 11/00; H04R 3/00; H04R 3/007; H04R 9/025; H04R 7/00;
(Continued)

(56) References Cited

U.S. PATENT DOCUMENTS

2004/0202347 A1* 10/2004 Koike ..... H04R 9/00 381/431
2012/0177215 A1* 7/2012 Bose ..... G01D 5/2417 381/74

FOREIGN PATENT DOCUMENTS

CN 1198759 A 11/1998
CN 2519575 Y 10/2002
(Continued)

OTHER PUBLICATIONS

International Search Report dated Jan. 29, 2016 in International Patent Application No. PCT/CN2015/095680.
(Continued)

*Primary Examiner* — David L Ton
(74) *Attorney, Agent, or Firm* — Michele V. Frank; Venable LLP

(57) ABSTRACT

Disclosed is a structure for detecting the vibration displacement of a speaker, including: a vibration system having a movable pole plate; a magnetic circuit system; and a fixed pole plate provided under the vibration system and opposite to the movable pole plate, the movable pole plate and the fixed pole plate constituting a capacitor. Also disclosed is an acoustoelectric inter-conversion dual-effect device, further including an impedance transformer connected to the capacitor and including a field effect transistor and a diode. In the present invention, a movable pole plate of a capacitor is provided on a vibration system and a fixed pole plate is provided under the vibration system and fixed in position. When the vibration system vibrates, the change in capacitance is detected to calculate the actual displacement of the
(Continued)

vibration system, which can reduce the power of the speaker device when the actual displacement of the vibration system exceeds a safety threshold. For an electronic device adopting such a speaker structure, the displacement of the vibration system of a speaker product can be detected in real time at the system end of the electronic device.

14 Claims, 4 Drawing Sheets

(51) Int. Cl.

| | |
|---|---|
| ***H04R 7/06*** | (2006.01) |
| ***H04R 7/18*** | (2006.01) |
| ***H04R 9/02*** | (2006.01) |
| ***H04R 29/00*** | (2006.01) |
| ***H04R 31/00*** | (2006.01) |
| ***H04R 19/01*** | (2006.01) |

(52) U.S. Cl.
CPC ..... *H04R 9/025* (2013.01); *H04R 29/001* (2013.01); *H04R 31/006* (2013.01); *H04R 19/013* (2013.01)

(58) Field of Classification Search
CPC ... H04R 7/10; H04R 7/04; H04R 7/06; H04R 7/18
See application file for complete search history.

(56) References Cited

FOREIGN PATENT DOCUMENTS

| | | | | |
|---|---|---|---|---|
| CN | 102128641 | A | 7/2011 | |
| CN | 104780489 | A | 7/2015 | |
| CN | 204518064 | U | 7/2015 | |
| EP | 0885918 | A1 * | 12/1998 | ..... C08J 5/18 |

OTHER PUBLICATIONS

Written Opinion dated Jan. 29, 2016 in International Patent Application No. PCT/CN2015/095680.

* cited by examiner

STRUCTURE FOR DETECTING VIBRATION DISPLACEMENT OF A SPEAKER AND ACOUSTOELECTRIC INTER-CONVERSION DUAL-EFFECT DEVICE

CROSS REFERENCE TO RELATED APPLICATION

This application is a national stage application, filed under 35 U.S.C. § 371, of International Application No. PCT/CN2015/095680, filed on Nov. 26, 2015, which claims priority to Chinese Application No. 201510149780.0 filed on Mar. 31, 2015 and Chinese Application No. 201520763528.4 filed on Sep. 29, 2015, the contents of which are hereby incorporated by reference in their entirety.

FIELD OF THE INVENTION

The present disclosure relates to a structure for detecting vibration displacement of a speaker and an acoustoelectric inter-conversion dual-effect device.

BACKGROUND OF THE INVENTION

In the prior art, whether for a micro speaker or a large speaker, the problem which limits the maximum power application of the product when operating in low frequency conditions lies in that: under a large power, the voice coil operating in low frequency conditions produces an excessive displacement which will cause abrupt raising distortion and even causes an obvious collision problem between the voice coil and the magnetic circuit system, which will cause mechanical damage to the product system.

For this problem, the current solution is to adopt an intelligent power amplification control unit to control the power of the speaker product. The actual displacement of the vibration system of the speaker is "deduced" according to input information (such as voltage) and monitored information (such as current) and physical parameters of the speaker. The power of the speaker product is reduced when the actual displacement exceeds a preset threshold.

However, the deduction of the actual displacement by the intelligent power amplification control unit is still built on a hypothetical theoretical model which still has certain differences from the actual product. In addition, for micro speakers produced in batch, there are always some deviations in the physical parameters of the speakers and 100% consistence cannot be realized. The above reason causes that it is difficult for the deduction of the actual displacement by the intelligent power amplification control unit to reflect the real displacement of each speaker product precisely and in real time.

SUMMARY OF THE INVENTION

An object of embodiments of the present invention is to provide a new solution for detecting the vibration displacement of a speaker device.

According to a first aspect of embodiments of the present invention, a structure for detecting the vibration displacement of a speaker is provided, including: a vibration system having a movable pole plate; a magnetic circuit system; and a fixed pole plate provided under the vibration system and opposite to the movable pole plate, the movable pole plate and the fixed pole plate constituting a capacitor.

Optionally, the vibration system includes a diaphragm and a voice coil located under the diaphragm, the diaphragm includes an electret layer and a metal layer attached to the electret layer, and the electret layer and the metal layer constitute the movable pole plate.

Optionally, the diaphragm also includes a plastic film layer laminated with the movable pole plate and the plastic film layer is a film with a single layer or a film with a plurality of layers which are laminated.

Optionally, the vibration system includes a diaphragm and a voice coil located under the diaphragm, the diaphragm includes a diaphragm body portion and a reinforcement portion, the diaphragm body portion includes a planar portion in the middle, a surround portion located at the edge of the planar portion and a fixture portion located on the outermost, the reinforcement portion is provided on the planar portion; and the diaphragm body portion includes an electret layer and a metal layer attached to the electret layer, and the electret layer and the metal layer constitute the movable pole plate.

Optionally, the diaphragm body portion also includes a plastic film layer laminated with the movable pole plate and the plastic film layer is a film with a single layer or a film with a plurality of layers which are laminated.

Optionally, the electret layer covers the whole area of the diaphragm body portion or merely covers the area of the planar portion.

Optionally, the metal layer covers the whole area of the diaphragm body portion; or, the metal layer includes a first area completely covering the planar portion, a second area completely covering the fixture portion and a third area partially covering the surround portion, wherein the third area communicates with the first area and the second area.

Optionally, the metal layer is located at the uppermost layer of the diaphragm body portion, wherein an electrical connector is set on the metal layer above the fixture portion.

Optionally, the electrical connector is a metal connector or conductive resin coated on the metal layer.

Optionally, the structure further comprises a thermal insulator material layer provided between the diaphragm and the voice coil, the thermal insulator material layer covers the whole area of one side of the diaphragm close to the voice coil or merely covers the area of the diaphragm connected to the voice coil.

Optionally, the magnetic circuit system is located under the vibration system and includes a washer, the washer being the fixed pole plate.

Optionally, the magnetic circuit system further includes a magnet and a frame located under the washer, and an opening is provided at the center of the washer, the magnet and the frame.

Optionally, the material of the electret layer includes any or a combination of: polytetrafluoroethylene, polyvinyldifluoride, polyvinylidene fluoride, polyethylene, polypropylene, polyetherimide, or polyethylene terephthalate.

Optionally, the vibration system includes a diaphragm and a voice coil located under the diaphragm, and the magnetic circuit system is located under the vibration system and includes a washer and a magnet; and the movable pole plate is attached to the diaphragm, the upper surface of the washer is provided with an electret film, and the electret film is a fixed pole plate.

Optionally, the movable pole plate is a metal layer or a flexible circuit board layer with a metal layer in the middle; or, the metal layer or the flexible circuit board layer with a metal layer in the middle are attached on or under the diaphragm.

According to a second aspect of embodiments of the present invention, an acoustoelectric inter-conversion dual-effect device is provided, comprising the structure mentioned above and an impedance transformer connected to the capacitor and including a field effect transistor and a diode.

The inventors of embodiments of the present invention have found that there is no technical solution to detect the actual displacement of a vibration system by detecting the change in capacitance. Thus, such a solution for solving problems has never been contemplated or predicted by those skilled in the art. Therefore, each of embodiments of the present invention is a new technical solution.

The embodiments of the present invention designs a capacitor structure for detecting the vibration displacement of a vibration system. The movable pole plate of the capacitor is provided on a vibration system and a fixed pole plate is provided under the vibration system and fixed in position. When the vibration system vibrates, the change in capacitance is detected to calculate the actual displacement of the vibration system, which can reduce the power of the speaker device when the actual displacement of the vibration system exceeds a safety threshold. For an electronic device adopting such a speaker structure, the displacement of each speaker product can be detected in real time at the system end of the electronic device.

The other features and advantages of the present invention will become clear according to the detailed description of exemplary embodiments of the present invention with reference to the accompanying drawings.

BRIEF DESCRIPTION OF THE DRAWINGS

The accompanying drawings incorporated in the description and constituting a part of the description illustrate the embodiments of the present invention and used to explain the principle of the present invention along therewith.

REFERENCE SIGNS

Figure 1:
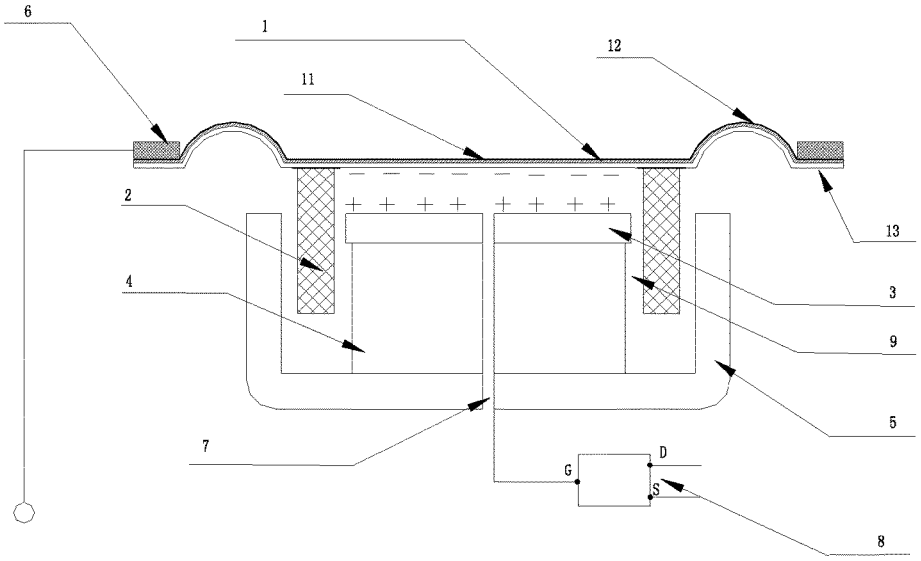
FIG. 1 is a view of an embodiment of a structure for detecting the vibration displacement of a speaker according to a first implementation of the present invention.

1 diaphragm, 2 voice coil, 3 washer, 4 magnet, 5 frame, 61 electrical connector, 6, metal connector, 7 opening, 8 field effect transistor, 9 inner magnetic gap; 11 planar portion, 12 surround portion, 13 fixture portion, 101 electret layer, 102 metal layer, 103 plastic film layer, 104 thermal insulator material layer; 1021 first area, 1022 second area, 1023 third area; 100 metal layer, 200 flexible circuit board layer with metal layer in the middle, 300 electret film, 201 central portion, 202 ring portion, and 203 connector portion.

DETAILED DESCRIPTION OF THE EMBODIMENTS

Various exemplary embodiments of the present invention will be described in detail with reference to the accompanying drawings. It should be noted that unless stated specifically otherwise, the relative arrangement of the components and steps illustrated in these embodiments, the numeral expressions and the values do not limit the scope of the present invention.

The description of at least one exemplary embodiment of the present invention is actually merely illustrative rather than limiting the present invention and the application or use thereof.

Technologies, methods and devices known to those skilled in the art may not be described in detail, but when appropriate, the technologies, methods and devices shall be regarded as a part of the description.

Any particular value in all examples illustrated and described here shall be construed as merely illustrative rather than limiting. Thus, other examples of the exemplary embodiments may have different values.

It should be noted that similar signs and letters represent similar items in the following figures, and thus, once a certain item is defined in a figure, there is no need to further describe the same in the following figures.

The embodiments of the present invention designs a capacitor structure for detecting the actual vibration displacement of a vibration system of a speaker. The capacitor is constituted by a movable pole plate and a fixed pole plate opposite to the movable pole plate. The movable pole plate is a part of the vibration system and vibrates along with the vibration system. The fixed pole plate is provided under the vibration system and fixed relative to the housing location of the speaker. When the vibration system vibrates, the movable pole plate also vibrates. The distance between two pole plates changes, causing change in capacitance. The actual displacement of the vibration system can be calculated by directly monitoring the value change of the capacitor or indirectly monitoring the current change of the circuit connected to the capacitor.

During the application of embodiments of the present invention, whether the actual displacement of the vibration system has exceeded a preset safety threshold can be monitored, and if yes, the input power of the speaker will be reduced. Whether the value change of the capacitor has exceeded a preset safety threshold can be monitored, and if yes, the input power of the speaker will be reduced. Whether the current change of the circuit connected to the capacitor has exceeded a preset safety threshold can be monitored, and if yes, the input power of the speaker will be reduced.

The embodiments of the present invention may connect an intelligent power amplification control unit to the capacitor to monitor the actual displacement of the vibration system and reduce the input power of the speaker when necessary, protecting the speaker from overdue distortion or being subjected to physical damage.

(I) Description of a Structure for Detecting the Vibration Displacement of a Speaker According to a First Implementation of the Present Invention with Reference to FIGS. 1 to 7.

The vibration system of a speaker includes a diaphragm and a voice coil located under the diaphragm. The embodiments of the present invention may use the diaphragm to constitute a movable pole plate. In particular, the diaphragm at least includes an electret layer and a metal layer attached to the electret layer. The electret layer and the metal layer constitute the movable pole plate. When the energized voice coil vibrates under the effect of the magnetic circuit system, the voice coil drives the diaphragm to vibrate. The vibration of the diaphragm will make the capacitor constituted by the movable pole plate and the fixed pole plate change. Since the electret layer has stable charges, the actual displacement of the vibration system can be calculated by monitoring the change in capacitance of the capacitor. Alternatively, the actual displacement of the vibration system can be calculated by indirectly monitoring the current change of the circuit connected to the capacitor.

Referring to FIG. 1, the vibration system of a speaker includes a diaphragm 1 and a voice coil 2 located under the diaphragm 1. The diaphragm 1 includes a diaphragm body portion and a reinforcement portion (not shown). The diaphragm body portion includes a planar portion in the middle, a surround portion 12 at the edge of the planar portion 11 and a fixture portion 13 on the outermost. The fixture portion 13 is used to fix the diaphragm in the speaker device. The reinforcement portion is provided on the planar portion 11. The magnetic circuit system of the speaker is located under the vibration system, including a washer 3, a magnet 4 and a frame 5 successively from top to bottom.

The diaphragm body portion at least includes an electret layer and a metal layer attached to the electret layer. The electret layer and the metal layer constitute the movable pole plate. In order to improve the elastic property of the diaphragm, the diaphragm body portion may also include a conventional plastic film layer (a film with a single layer or a film with a plurality of layers which are laminated). The material of the electret layer may include any or a combination of: polytetrafluoroethylene, polyvinyl-difluoride, polyvinylidene fluoride, polyethylene, polypropylene, polyetherimide, or polyethylene terephthalate.

Referring to FIG. 1, the washer 3 is used as the fixed pole plate. In order to keep a pressure equalization between the diaphragm 1 and the washer 3, provided is an inner magnetic gap 9 between the diaphragm 1 and the washer 3. Furthermore, opening can be performed at the center of the inner magnetic circuit. In particular, an opening 7 is provided at the center of the washer 3, the magnet 4 and the frame 5. Since both the magnet 4 and the frame 5 are conductors, the fixed pole plate and the external circuit can be connected from the bottom of the frame 5. Of course, the fixed pole plate may also be designed independently.

Figure 2:
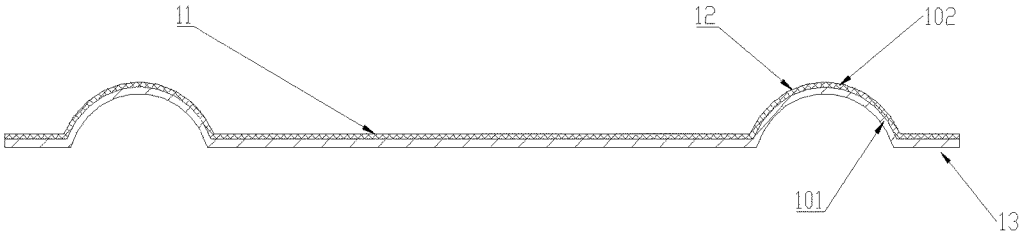
FIG. 2 is a view of a first embodiment of a diaphragm body portion of a structure for detecting the vibration displacement of a speaker according to a first implementation of the present invention.

FIG. 2 shows a first embodiment of a diaphragm body portion according to a first implementation of the present invention. The diaphragm body portion includes an electret layer 101 and a metal layer 102 attached to the electret layer 101. The metal layer 102 is located on the electret layer 101. The electret layer 101 and the metal layer 102 constitute a movable pole plate of a capacitor. The electret layer 101 can be formed by an electret material which is polarized. The electret layer 101 and the metal layer 102 both cover the whole area of the diaphragm body portion.

In order to improve the elastic property of the diaphragm, the diaphragm body portion may also include a conventional plastic film layer (a film with a single layer or a film with a plurality of layers which are laminated), that is, being formed by coating an electret layer and a metal layer attached to the electret layer on an upper surface or a lower surface of the conventional plastic film layer.

Figure 3:
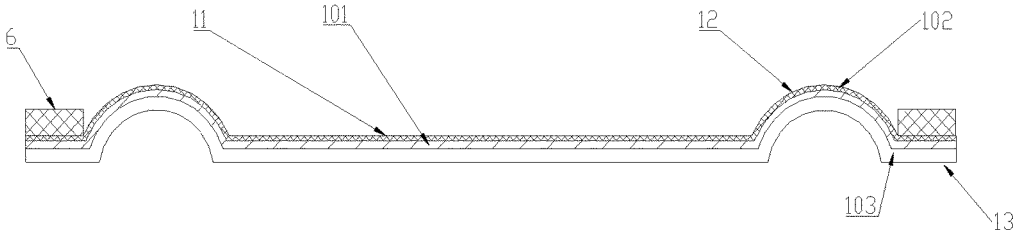
FIG. 3 is a view of a second embodiment of a diaphragm body portion of a structure for detecting the vibration displacement of a speaker according to a first implementation of the present invention.

FIG. 3 shows a second embodiment of a diaphragm body portion according to a first implementation of the present invention. The diaphragm body portion includes a metal layer 102, an electret layer 101 and a plastic film layer 103 successively from top to bottom. The electret layer 101 and the metal layer 102 both cover the whole area of the diaphragm body portion. The metal layer 102 is located on the uppermost layer of the diaphragm body portion. An electrical connector is set on the metal layer 102 above the fixture portion 13. The electrical connector may be a metal connector 6 (such as metal ring) or conductive resin coated on the metal layer 102. The metal layer 102 may be grounded or connected to an external circuit through the electrical connector.

Figure 4:
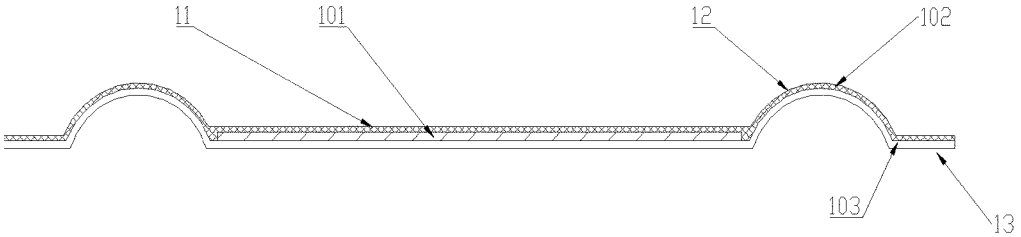
FIG. 4 is a view of a third embodiment of a diaphragm body portion of a structure for detecting the vibration displacement of a speaker according to a first implementation of the present invention.

FIG. 4 shows a third embodiment of a diaphragm body portion according to a first implementation of the present invention. Difference from the second embodiment in FIG. 3 lies in that, in order to reduce the effect to the smoothness of the surround portion 12 of the diaphragm 1 by the electret layer 101 as much as possible, the electret layer 101 merely covers the region of the planar portion 11 of the diaphragm.

Figure 5:
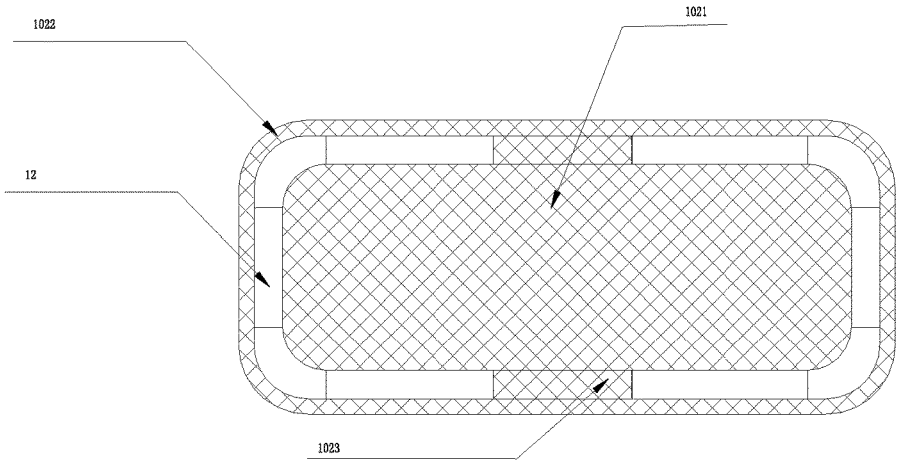
FIG. 5 is a view of a fourth embodiment of a diaphragm body portion of a structure for detecting the vibration displacement of a speaker according to a first implementation of the present invention.

FIG. 5 shows a fourth embodiment of a diaphragm body portion according to a first implementation of the present invention. Difference from the second embodiment in FIG. 3 lies in that, in order to reduce the effect to the smoothness of the surround portion 12 of the diaphragm 1 by the electret layer 101 as much as possible, the metal layer 102 includes a first area 1021 completely covering the planar portion 11, a second area 1022 completely covering the fixture portion 13 and a third area 1023 partially covering the surround portion 12, wherein the third area 1023 communicates with the first area 1021 and the second area 1022.

Figure 6:
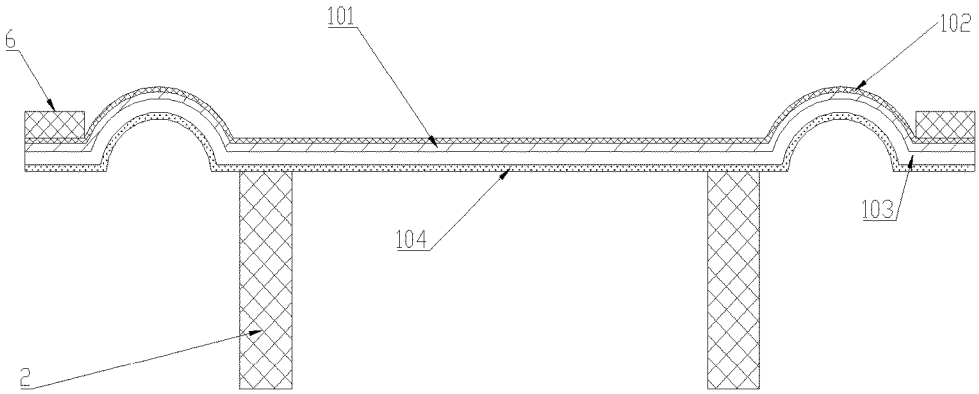
FIG. 6 is a view of a first embodiment of adding a thermal insulator material layer for a structure for detecting the vibration displacement of a speaker according to a first implementation of the present invention.
Figure 7:
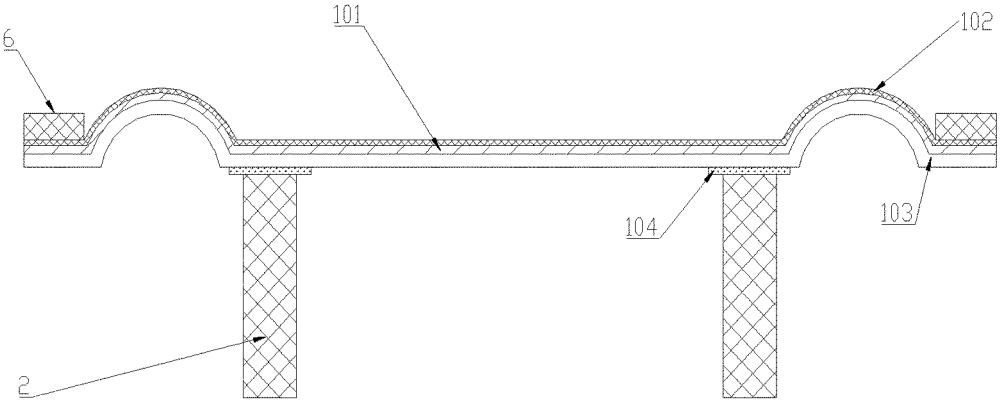
FIG. 7 is a view of a second embodiment of adding a thermal insulator material layer for a structure for detecting the vibration displacement of a speaker according to a first implementation of the present invention.

The embodiments of the present invention may also include a thermal insulator material layer 104 provided between the diaphragm 1 and the voice coil 2 to avoid the heat of the voice coil under large power being transferred to the electret layer 101 to cause the performance of the electret layer 101 reduced. FIG. 6 shows a first embodiment with the added thermal insulator material layer 104 according to a first implementation of the present invention. The thermal insulator material layer 104 covers the whole area of one side of the diaphragm 1 close to the voice coil 2. FIG. 7 shows a second embodiment with the added thermal insulator material layer 104 according to a first implementation of the present invention. Difference from the first embodiment in FIG. 6 lies in that, in order to reduce the effect to the smoothness of the surround portion 12 of the diaphragm 1 by the thermal insulator material layer 104 as much as possible, the thermal insulator material layer 104 merely covers the region of the planar portion 11 of the diaphragm. The heat conduction coefficient of the thermal insulator material layer 104 is not greater than 10 W/(m*K). A nanometer composite material may be adopted and the thickness may be controlled within 1~100 nm.

Referring to FIG. 1, when the energized voice coil 2 vibrates under the effect of the magnetic circuit system, the voice coil 2 drives the diaphragm 1 to vibrate. The vibration of the diaphragm 1 will make the capacitance value of the capacitor constituted by the movable pole plate and the fixed pole plate change. Since the electret layer 101 has stable charges, the actual displacement of the diaphragm 1 can be calculated by monitoring the change in capacitance of the capacitor.

Referring to FIG. 1, since the magnet 4 and the frame 5 are both conductors, the fixed pole plate may be connected to an impedance transformer through the bottom of the frame 5. The impedance transformer includes a field effect transistor 8 and a diode (not shown). The impedance transformer is then connected to a power amplifier of the system end. Furthermore, the power amplifier may be connected to an intelligent power amplification control unit which is used for detecting the change in the capacitance value of the capacitor and calculating the actual displacement of the vibration system to control the input power of the speaker device.

Since the speaker with an impedance transformer possesses all core parts of a capacitive microphone, it may also be used as a capacitive microphone. The embodiments of the present invention also provides an acoustoelectric interconversion dual-effect device, including: a vibration system having a movable pole plate; a magnetic circuit system; a fixed pole plate provided under the vibration system and opposite to the movable pole plate, the movable pole plate and the fixed pole plate constituting a capacitor; and an impedance transformer connected to the capacitor and including a field effect transistor 8 and a diode. The dual-effect device may be used as a speaker or a microphone.

Figure 8:
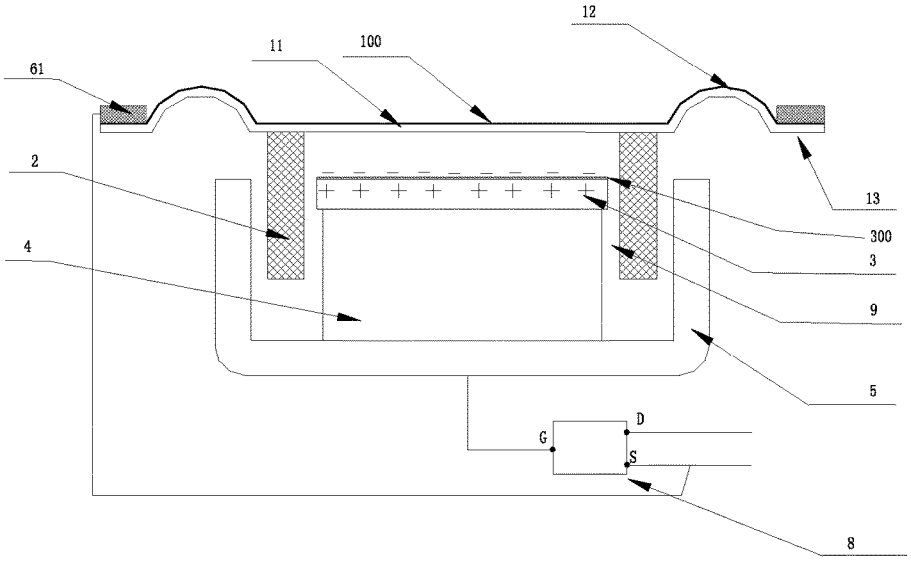
FIG. 8 is a view of a first embodiment of a structure for detecting the vibration displacement of a speaker according to a second implementation of the present invention.
Figure 9:
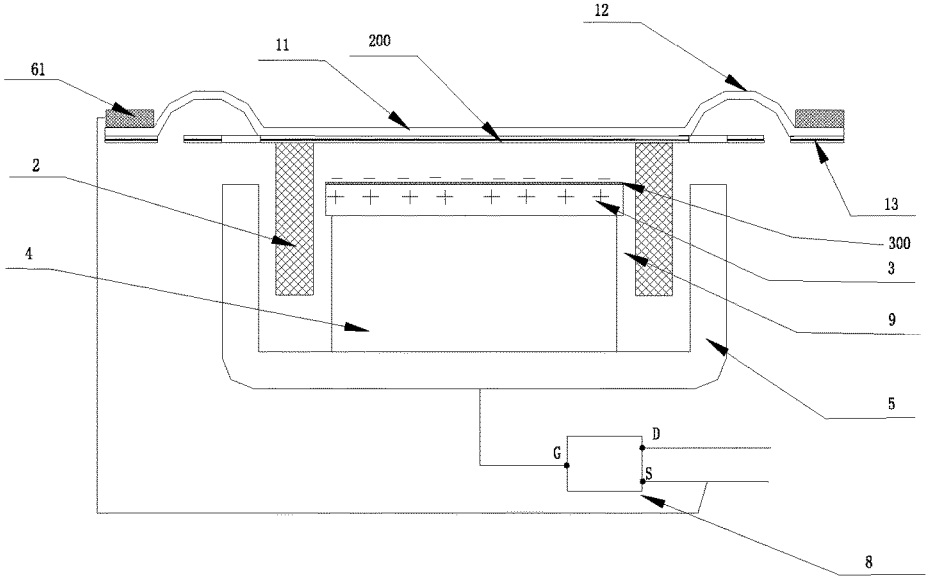
FIG. 9 is a view of a second embodiment of a structure for detecting the vibration displacement of a speaker according to a second implementation of the present invention.
Figure 10:
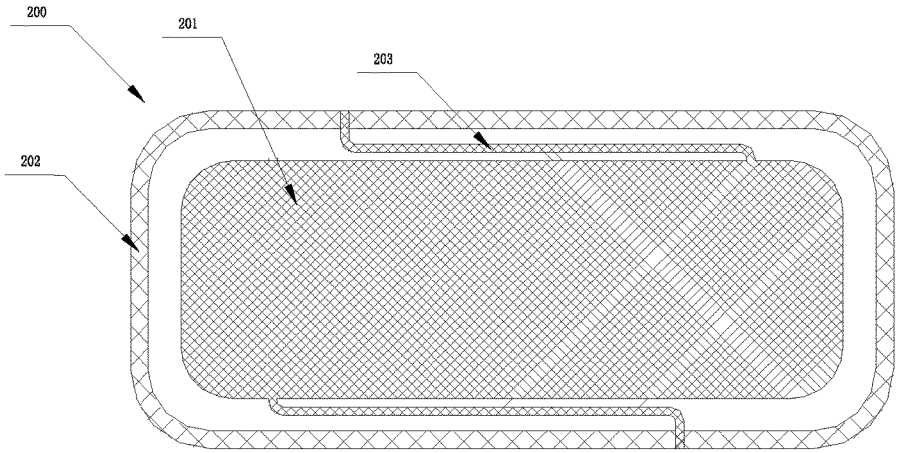
FIG. 10 is a structure diagram of a flexible circuit board layer with a metal layer in the middle in the embodiment shown in FIG. 9.

(II) Description of a Structure for Detecting the Vibration Displacement of a Speaker According to a Second Implementation of the Present Invention with Reference to FIGS. 8-10.

FIG. 8 shows a first embodiment of a structure for detecting the vibration displacement of a speaker according to a second implementation of the present invention. The vibration system of the speaker includes a diaphragm and a voice coil located under the diaphragm. The diaphragm includes a planar portion 11 in the middle, a surround portion 12 at the edge of the planar portion 11 and a fixture portion 13 on the outermost. The fixture portion 13 is used to fix the diaphragm in the speaker device. The magnetic circuit system of the speaker is located under the vibration system, including a washer 3, a magnet 4 and a frame 5 successively from top to bottom.

The upper surface of the washer 3 is provided with an electret film 300. The electret film 300 is a fixed pole plate. In order to keep pressure equalization between the diaphragm and the washer 3, provided is an inner magnetic gap 9 between the diaphragm and the washer 3.

The electret film 300 may be formed by an electret material which is polarized. The electret film 300 may cover the whole area of the upper surface of the washer 3. The material of the electret layer 300 may be any or a combination of: polytetrafluoroethylene, polyvinyl-difluoride, polyvinylidene fluoride, polyethylene, polypropylene, polyetherimide, or polyethylene terephthalate. The material of the electret layer 300 is preferably polytetrafluoroethylene and has charges after polarization.

The movable pole plate may be formed using the diaphragm. The movable pole plate in FIG. 8 is a metal layer 100. It can be seen from FIG. 8 that the metal layer 100 is attached only on the planar 11 of the diaphragm in order to reduce the effect to the smoothness of the surround portion 12 of the diaphragm by the metal layer 100 as much as possible. In other embodiments, the metal layer 100 may be attached also on the fixture portion 13 of the diaphragm. In other embodiments, the metal layer 100 may be attached also under the diaphragm.

The material of the diaphragm is preferably silica or silicon rubber. Both the two materials can be resistant to high temperature of 140□ to avoid product performance degradation at high temperature. In order to improve the elastic property of the diaphragm, the diaphragm may also include a conventional plastic film layer (a film with a single layer of film or a film with a plurality of layers which are laminated).

When the energized voice coil 2 vibrates under the effect of the magnetic circuit system, the voice coil 2 drives the diaphragm to vibrate. The vibration of the diaphragm will make the capacitance value of the capacitor constituted by the movable pole plate and the fixed pole plate change. Since the electret film 300 has stable charges, the actual displacement of the vibration system can be calculated by monitoring the change in capacitance of the capacitor. Alternatively, the actual displacement of the vibration system can also be calculated by indirectly monitoring the current change of the circuit connected to the capacitor.

FIG. 9 shows a second embodiment of a structure for detecting the vibration displacement of a speaker according to a second implementation of the present invention. Difference from the first embodiment in FIG. 8 lies in the way in which the movable pole plate is provided. The movable pole plate in FIG. 9 is a flexible circuit board layer 200 with a metal layer in the middle which is attached under the diaphragm.

It can be seen from FIG. 10 that the flexible circuit board layer 200 with a metal layer in the middle includes a central portion 201, an annular portion 202 enclosing the central portion 201 and a connector portion 203 connecting the central portion 201 and the annular portion 202. The annular portion 202 covers the fixture portion 11 of the diaphragm. The central portion 11 covers the planar portion 11 of the diaphragm and extends below the surround portion 12. It should be noted that the shape and provision of the metal layer 100 in the first embodiment may be the same as those of the flexible circuit board layer 200 with a metal layer in the middle in the second embodiment.

Referring to FIGS. 8 and 9, an electrical connector 61 is provided on the fixture portion 13 of the diaphragm. The electrical connector 61 may be a metal connector (such as metal ring) or other electrical connector structure. The movable pole plate of the capacitor may be grounded or connected to an external circuit through the electrical connector 61. Since the magnet 4 and the frame 5 are both conductors, the fixed pole plate can be connected to the external circuit from the bottom of the frame 5.

Since the magnet 4 and the frame 5 are both conductors, the fixed pole plate may be connected to an impedance transformer through the bottom of the frame 5. The impedance transformer includes a field effect transistor 8 and a diode (not shown). The impedance transformer is then connected to a power amplifier of the system end. Furthermore, the power amplifier may be connected to an intelligent power amplification control unit which is used for detecting the change in the capacitance value of the capacitor and calculating the actual displacement of the vibration system to control the input power of the speaker device.

Since the speaker with an impedance transformer possesses all core parts of a capacitive microphone, it may also be used as a capacitive microphone. The embodiments of the present invention also provides an acoustoelectric conversion dual-effect device, including: a vibration system having a movable pole plate; a magnetic path system; a fixed pole plate provided under the vibration system and opposite to the movable pole plate, the movable pole plate and the fixed pole plate constituting a capacitor; and an impedance transformer connected to the capacitor and including a field effect transistor 8 and a diode. The dual-effect device may be used as a speaker or a microphone.

Although some specific embodiments of the present invention have been described in detail by way of example, it should be understood by those skilled in the art that the above examples are merely for the sake of description rather than limiting the scope of the present invention. It should be understood by those skilled that the above embodiments may be modified without departing from the scope and spirit of the present invention. The scope of the present invention is limited by the appended claims.

What is claimed is:

1. A structure for detecting the vibration displacement of a speaker, comprising:

a vibration system having a movable pole plate, wherein the vibration system includes a diaphragm and a voice coil located under the diaphragm, the diaphragm includes a planar portion in the middle;

a magnetic circuit system; and a fixed pole plate provided under the vibration system and opposite to the movable pole plate, wherein the movable pole plate and the fixed pole plate constituting a capacitor, wherein the magnetic circuit system is located under the vibration system and includes a washer which is the fixed pole plate.

2. The structure according to claim 1, wherein the diaphragm includes an electret layer and a metal layer attached to the electret layer, and the electret layer and the metal layer constitute the movable pole plate.

3. The structure according to claim 2, further comprising a thermal insulator material layer provided between the diaphragm and the voice coil, and the thermal insulator material layer covers the whole area of one side of the diaphragm close to the voice coil or merely covers an area of the diaphragm connected to the voice coil.

4. The structure according to claim 2, wherein the material of the electret layer includes any or a combination of: polytetrafluoroethylene, polyvinyl-difluoride, polyvinylidene fluoride, polyethylene, polypropylene, polyetherimide, or polyethylene terephthalate.

5. The structure according to claim 2, wherein the diaphragm further includes a plastic film layer laminated with the movable pole plate, wherein the plastic film layer is a film with a single layer or a film with a plurality of layers which are laminated.

6. The structure according to claim 1, wherein the diaphragm includes a diaphragm body portion and a reinforcement portion, the diaphragm body portion includes the planar portion in the middle, a surround portion located at the edge of the planar portion and a fixture portion located on the outermost, and the reinforcement portion is provided on the planar portion; and the diaphragm body portion includes an electret layer and a metal layer attached to the electret layer, and the electret layer and the metal layer constitute the movable pole plate.

7. The structure according to claim 6, wherein the diaphragm body portion further includes a plastic film layer laminated with the movable pole plate and the plastic film layer is a film with a single layer or a film with a plurality of layers which are laminated.

8. The structure according to claim 6, wherein the electret layer covers the whole area of the diaphragm body portion or merely covers the area of the planar portion.

9. The structure according to claim 6, wherein the metal layer covers the whole area of the diaphragm body portion; or, the metal layer includes a first area completely covering the planar portion, a second area completely covering the fixture portion and a third area partially covering the surround portion, wherein the third area communicates with the first area and the second area.

10. The structure according to claim 6, wherein the metal layer is located at the uppermost layer of the diaphragm body portion, and an electrical connector is set on the metal layer above the fixture portion.

11. The structure according to claim 10, wherein the electrical connector is a metal connector or conductive resin coated on the metal layer.

12. The structure according to claim 1, wherein the magnetic circuit system further includes a magnet and a frame located under the washer, and an opening is provided at the center of the washer, the magnet and the frame.

13. The structure according to claim 1, wherein the movable pole plate is attached to the diaphragm, the movable pole plate is a metal layer or a flexible circuit board layer with a metal layer in the middle; and the metal layer or the flexible circuit board layer with a metal layer in the middle are attached on or under the diaphragm.

14. An acoustoelectric inter-conversion dual-effect device, comprising the structure of claim 1 and an impedance transformer which is connected to the capacitor and includes a field effect transistor and a diode.

* * * * *